US006978745B1

(12) United States Patent
Flohr

(10) Patent No.: US 6,978,745 B1
(45) Date of Patent: Dec. 27, 2005

(54) SYSTEM FOR CONTROLLING ELECTROMECHANICAL VALVES IN AN ENGINE

(75) Inventor: Gary Flohr, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/890,722

(22) Filed: Jul. 13, 2004

(51) Int. Cl.[7] ..... F01L 9/04

(52) U.S. Cl. ..... 123/90.11; 123/90.24; 123/90.15; 251/129.07; 251/129.09; 251/129.15; 251/129.16; 251/129.18; 335/268; 361/189; 361/301.1; 361/328; 323/259; 323/344

(58) Field of Search ..... 123/90.11; 251/129.07, 251/120.09, 129.18

(56) References Cited

U.S. PATENT DOCUMENTS 4,933,805 A * 6/1990 Calfus ..... 361/152
5,532,526 A * 7/1996 Ricco et al. ..... 307/104
5,953,198 A * 9/1999 Murata et al. ..... 361/195
6,175,484 B1 1/2001 Caruthers et al.
6,363,895 B1 4/2002 Butzmann et al.
6,526,945 B2 3/2003 Herzog et al.
6,626,146 B1 9/2003 Yanai et al.
6,772,737 B2 * 8/2004 Gaessler et al. ..... 123/490

* cited by examiner

*Primary Examiner*—Thomas Denion
*Assistant Examiner*—Kyle M. Riddle
(74) *Attorney, Agent, or Firm*—Allan J. Lippa; Alleman Hall McCoy Russell & Tuttle LLP

(57) ABSTRACT

A system for electronically actuating valves in an engine. The system includes first and second voltage sources, and a plurality of valve actuator subsystems coupled therebetween. Each valve actuator subsystem has a valve actuator and a switch configured to selectively control application of voltage to the valve actuator to thereby selectively control energization of the valve actuator. The system also includes a dissipation switch operatively coupled with the valve actuator subsystems, the dissipation switch being selectively operable to control dissipation of energy from any of the valve actuators.

24 Claims, 3 Drawing Sheets

SYSTEM FOR CONTROLLING ELECTROMECHANICAL VALVES IN AN ENGINE

FIELD

The present disclosure relates generally to systems for actuating valves in a camless engine.

BACKGROUND AND SUMMARY

Electronic or electromagnetic valve actuation (EVA) systems can be used in internal combustion engines to provide increased flexibility in terms of valve timing and/or lift, rather than being constrained by camshaft actuation. Such systems commonly include an electromagnetic actuator coil, which is energized with a current to generate an electromotive force for moving the valve and holding it in a desired position.

Existing EVA systems have certain disadvantages, depending on the setting in which they are used. One disadvantage relates to the need to provide a circulation path for freewheel current generated by the actuator coil after being energized (e.g., through application of a supply voltage). Typically, providing a circulation path for freewheel current requires multiple. switches and other components for each actuator coil, which increases manufacturing costs. For example, prior systems have employed a half bridge topology to allow for freewheel current circulation. The half bridge topology allows freewheel current from an actuator coil to flow through two freewheel diodes into a power bridge bus. To energize actuator coils and provide freewheel current circulation, the half bridge design requires two discrete MOSFET switches and two discrete diodes per actuator coil, for every coil. Another disadvantage is that many existing systems are inefficient in their inability to make use of the energy dissipated through freewheel currents.

The above disadvantages may be overcome by the system of the present description, which according to one aspect, comprises: a system for electronically actuating valves in an engine. The system includes a first voltage source, a second voltage source, and plural valve actuator subsystems coupled between the first voltage source and the second voltage source. Each valve actuator subsystem has a valve actuator and a switch. The system also includes a dissipation switch operatively coupled with the valve actuator subsystems, the dissipation switch being selectively operable to control dissipation of energy from any of the valve actuators.

In this way, it may be possible to reduce the number of switches per coil, while also providing faster coil turn-off and meeting the demand of valve actuators operating in the context of internal combustion engines.

BRIEF DESCRIPTION OF THE FIGURES

The above features and advantages will be readily apparent from the following detailed description of an example embodiment, or from the accompanying drawings.

DETAILED DESCRIPTION OF EXAMPLE EMBODIMENT(S)

One approach to reducing the number of switches and/or diodes per actuator coils is to use a single switch EVA valve actuation system that boosts the output voltage to twice the input voltage in order to generate a high enough EMF to attain the same turn off di/dt rate as a half or full bridge design where the coil voltage is allowed to reverse to -Vin plus two diode drops. A high turn off di/dt is desirable in order to quench the pull in current or holding current in the coil and thus reduce the force on the armature and valve quickly so that a soft landing of the valve may be achieved.

This disclosure describes a method which allows multiple coil driver circuits to operate from one fast turn off circuit. This fast turn off circuit is switched off (open) at the same time as the coil is turned off, and is held off until either the coil current has diminished to zero or until the coil has made a transition from holding (stationary position) to a midpoint position where by the inductance and current may be reduced to a point where there is reduced force (in one example, little or no force) produced by the coil armature.

Figure 1:
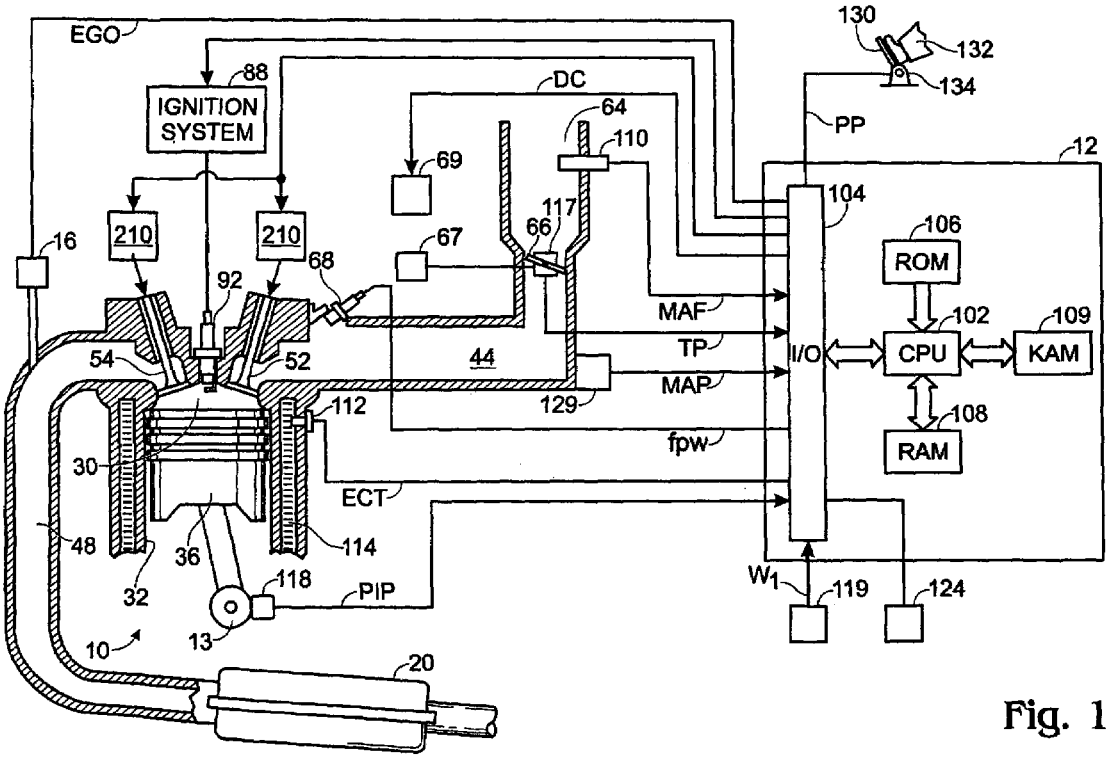
FIG. 1 is a block diagram of an engine illustrating various components related to the present disclosure.

Referring to FIG. 1, internal combustion engine 10 is shown. Engine 10 can be an engine of a passenger vehicle or truck driven on roads by drivers. Although not shown, Engine 10 can be coupled into a powertrain system of the vehicle. The powertrain can include a torque converter coupled to the engine 10 via a crankshaft. The torque converter can also be coupled to an automatic transmission via a turbine shaft. The torque converter can have a bypass clutch, which can be engaged, disengaged, or partially engaged. When the clutch is either disengaged or partially engaged, the torque converter is said to be in an unlocked state. The turbine shaft is also known as transmission input shaft. The transmission can comprise an electronically controlled transmission with a plurality of selectable discrete gear ratios. The transmission can also comprise various other gears such as, for example, a final drive ratio. The transmission can also be coupled to tires via an axle. The tires interface the vehicle to the road.

Internal combustion engine 10 comprising a plurality of cylinders, one cylinder of which, shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In one example, converter 20 is a three-way catalyst for converting emissions during operation about stoichiometry.

As described more fully below with regard to FIGS. 2A, 2B and 3, at least one of, and potentially both, of valves 52 and 54 are controlled electronically via apparatus 210 and/or system 310.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. In an alternative embodiment, no throttle is utilized and airflow is controlled solely using valves 52 and 54. Further, when throttle 66 is included, it can be used to reduce airflow if valves 52 or 54 become degraded, or if vacuum is desired to operate accessories or reduce induction related noise.

Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus. Further, keep alive memory (KAM) 109 is shown communicating with the CPU 102.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of manifold pressure (MAP) from MAP sensor 129, a measurement of throttle position (TP) from throttle position sensor 117 coupled to throttle plate 66; a measurement of transmission shaft torque, or engine shaft torque from torque sensor 124, a measurement of turbine speed (W1) from turbine speed sensor 119, where turbine speed measures the speed of the turbine shaft (output of a torque converter, if equipped), and a profile ignition pickup signal (PIP) from Hall effect sensor 118 coupled to crankshaft 13 indicating an engine speed (N) and position. Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle plate is not used, an air bypass valve (not shown) can be installed to allow a controlled amount of air to bypass throttle plate 66. In this alternative embodiment, the air bypass valve (not shown) receives a control signal (not shown) from controller 12.

Figure 2B:
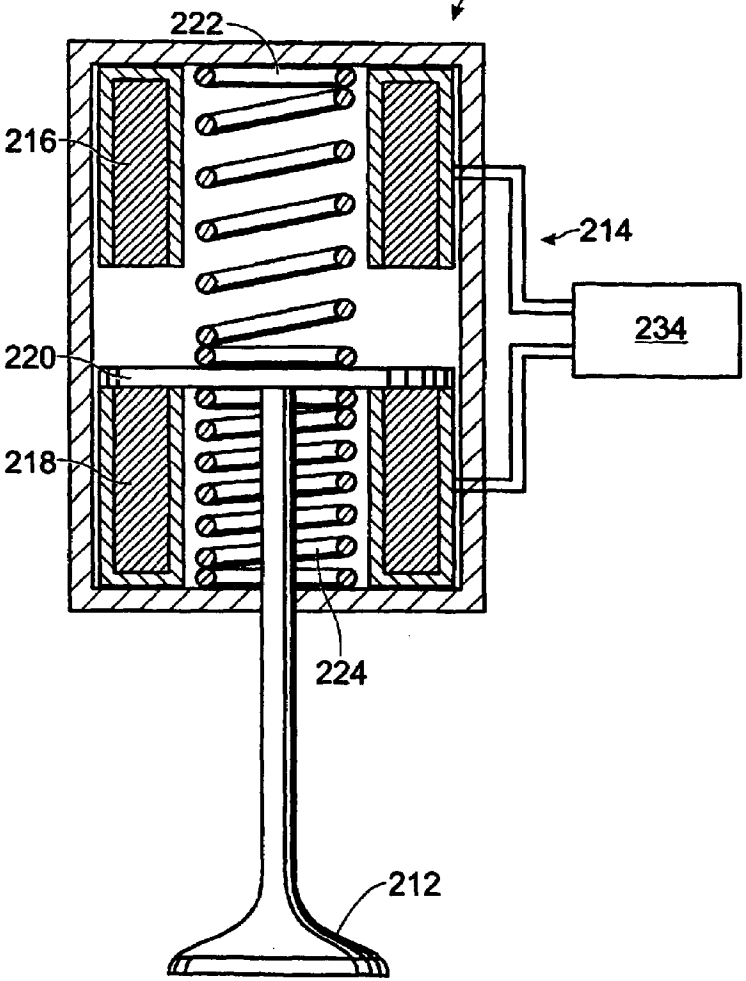
FIG. 2B shows a schematic vertical cross-sectional view of an apparatus for controlling valve actuation, with the valve in the fully open position.
Figure 2A:
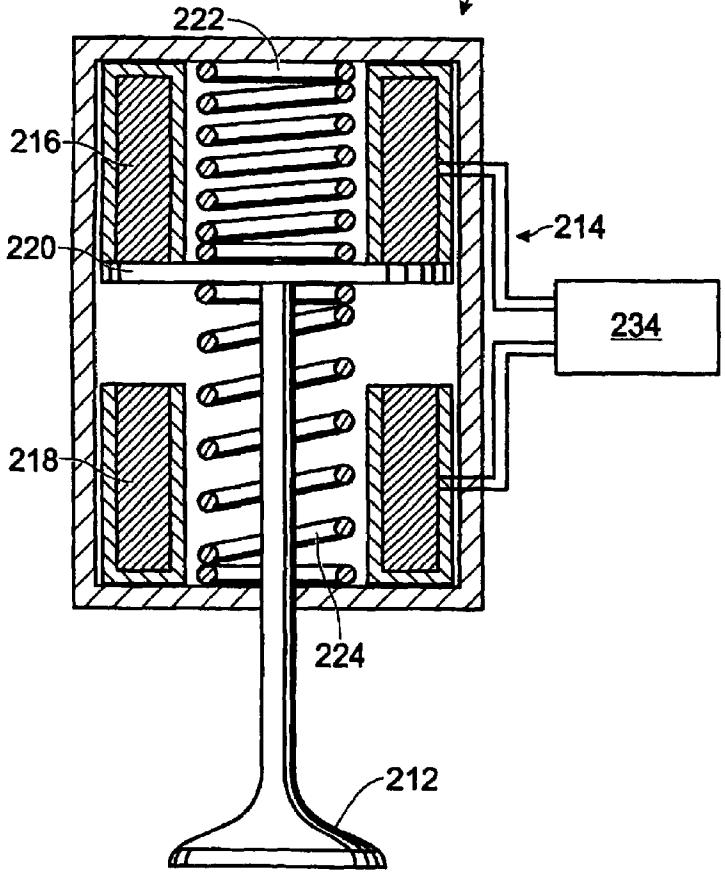
FIG. 2A shows a schematic vertical cross-sectional view of an apparatus for controlling valve actuation, with the valve in the fully closed position.

Referring to FIGS. 2A and 2B, an apparatus 210 is shown for controlling movement of a valve 212 in camless engine 10 between a fully closed position (shown in FIG. 2A), and a fully open position (shown in FIG. 2B). The valve 212 can be either or both of intake and exhaust valves 52 and 54 of FIG. 1. Also, if more than one intake and/or exhaust valve are used, such as in a 3-valve, or 4-valve engine, some or all of the valves can be electronically actuated as shown in FIGS. 2A and 2B.

The apparatus 210 includes an electromagnetic valve actuator (EVA) 214 with a controller 234 and upper and lower coils 216, 218 which electromagnetically drive an armature 220 against the force of upper and lower springs 222, 224 for controlling movement of the valve 212.

Switch-type position sensors (not shown) may be provided and installed so that they switch when the armature 220 crosses the sensor location. It is anticipated that switch-type position sensors can be easily manufactured based on optical technology (e.g., LEDs and photo elements) and when combined with appropriate asynchronous circuitry they would yield a signal with the rising edge when the armature crosses the sensor location. It is furthermore anticipated that these sensors would result in cost reduction as compared to continuous position sensors, and would be reliable.

Controller 234 (which can be combined into controller 12, or act as a separate controller) may be operatively connected to the position sensors, and to the upper and lower coils 216, 218 in order to control actuation and landing of the valve 212.

When multiple position sensors are provided, typically a first position sensor is located around the middle position between the coils 216, 218, a second sensor is located close to the lower coil 218, and a third sensor is located close to the upper coil 216. In addition, controller 234 may receive information from other sensors.

Due to the electronic control used above, it is possible to independently actuate cylinder valves operating in an internal combustion engine. This allows increased flexibility to directly control individual cylinder charge characteristics to yield desired torque and emissions output from the engine at various operating modes including variable displacement and variable stroke modes. As indicated above, the electronically actuated valve system can independently actuate the valves, or groups of valves, in the valvetrain to desired valve timings that are computed in an engine control unit (ECU) 12 and delivered to valve actuation controller (VAC) 234. Further, the desired valve timings can be desired valve opening timing, desired valve closing timing, desired valve opening duration, desired valve overlap, or various others.

In some cases, it may be desirable to employ permanent magnets in connection with coils 216 and 218. Permanent magnets may be used, for example, at the lower end of upper coil 216 in an area close to the upper point of armature travel (FIG. 2A), and/or at the upper end of lower coil 218 in an area close to the low point of armature travel (FIG. 2B). In certain settings, such use of permanent magnets may increase the electromagnetic force obtained for a given coil current and improve control of armature speed.

Figure 3:
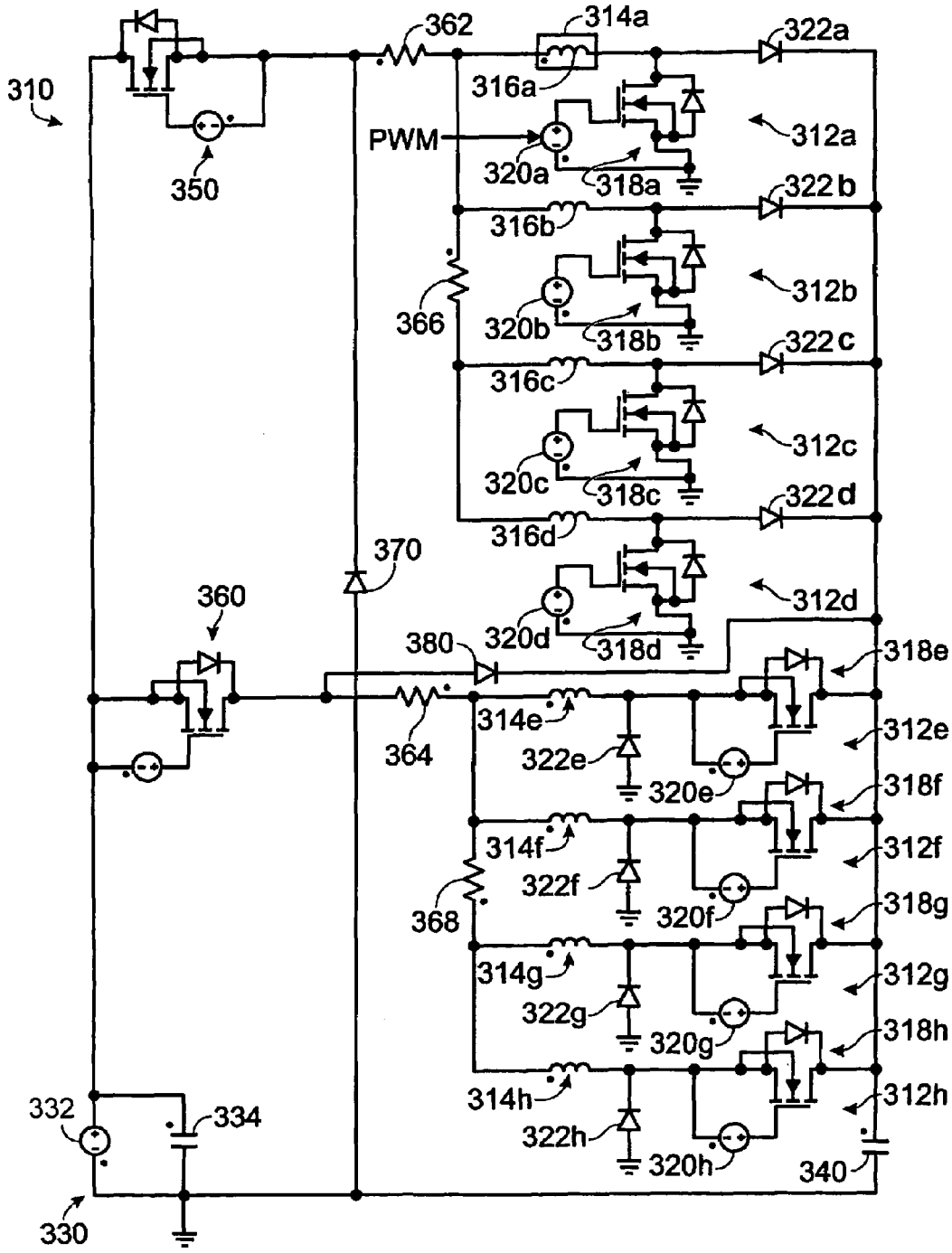
FIG. 3 is a schematic diagram showing a system for electronically controlling valve actuation, which may be implemented in connection with the components and apparatuses of FIGS. 1, 2A and 2B.

FIG. 3 depicts an exemplary system 310 that may be used to control operation of valves in an internal combustion engine, as described above. In particular, referring to FIGS. 1, 2A and 2B, system 310 may be incorporated within EVA actuator 214 and/or engine controller 12.

As shown in FIG. 3, system 310 includes several single-switch designs 312 (individually designated as 312*a*, 312*b*, etc. through 312*h*), which may also be referred to as valve actuator drivers or subsystems. The valve actuator subsystems may be configured in multiple banks and/or multiple stages, so as to allow freewheel current from one bank or stage to feed another bank (or banks) or stage (or stages). As will be discussed in more detail below, subsystems 312*a–h* form a first stage, while subsystems 312*a*, 312*b*, 312*c* and 312*d* form a first bank of subsystems in the depicted example and subsystems 312*e*, 312*f*, 312*g* and 312*h* form a second bank.

The valve actuator subsystems of the depicted example each include a number of common elements, which are referred to with like designators and a letter corresponding to the particular subsystem. For example, each subsystem includes a valve actuator 314, which may be a single coil of a dual coil actuator. For valve actuator subsystem 312*a*, the corresponding valve actuator is designated as valve actuator 314*a*; for subsystem 312*b*, the valve actuator is designated as valve actuator 314*b*, and so on. When referring generally to a component shown in more than one subsystem, the letter designator will be omitted.

As shown in the example, each valve actuator subsystem includes a valve actuator 314, which typically includes an actuator coil 316. The coil can be any of the coils used to open and/or close cylinder valves of an internal combustion engine, such as the coils 216, 218 used to move valve 212 in FIGS. 2A and 2B. Each actuator subsystem also includes a switch 318 (e.g., a MOSFET) controlled by a source 320 under pulse-width modulation (PWM) control (including held open and held closed), and a freewheel diode 322. PWM control is used to regulate coil current when the actuated valve is being held in a desired position (e.g., against the force of spring 222 or 224). For clarity, the PWM control signal is shown only for driver/subsystem 312*a*. Switch 318 in each subsystem is coupled within a charging or energizing current path of the subsystem, while freewheel diode 322 is coupled within a freewheel current path of the subsystem. These paths may be selectively enabled through operation of switch 318, as will be discussed in more detail below.

The valve actuation subsystems of the first stage are coupled substantially between a first energy storage device 330, which may include a power supply 332 and capacitor 334 in parallel with supply 332, and a second energy storage device such as capacitor 340. Note that additional stages can be used, coupled substantially between the second energy storage device and a third energy storage device. The energy storage devices typically are selected so as to provide predetermined supply voltages during operation of system 310. The supply voltages create desired regulated voltages across the stages, as will be explained more fully below. For example, in the depicted exemplary system, the components are selected so that during run-time normal operation, energy storage device 330 is at 21 (or 42) volts, energy storage device 340 is at 42 (or 84) volts, and the third energy storage device would be at 84 (or 168) volts, though other voltages may be employed. The second stage voltage drop in the example is twice the first stage voltage drop, so as to yield actuator currents that provide actuator turn-off rates that are the same for each stage.

The general operation of each valve actuation subsystem is as follows: first, valve actuation is initiated by closing switch 318. This enables a charging current pathway through actuator 314 and the closed switch. Current rises through the actuator (e.g., through one of coils 216, 218 of FIG. 2A and 2B) to a desired level, which typically is selected based on a predetermined or present closing or opening force for the valve. Current is driven through the actuator as a result of an applied voltage from a supply voltage provided by one of energy storage devices 330 or 340, for example. Various current sense resistors 362, 364, 366 and 368 may be provided to measure current through the actuators 314. When the current reaches a desired level corresponding to a desired force upon armature 220, switch 318 opens and closes rapidly as a result of a PWM control signal applied to supply 320. When the switch opens, freewheel current flows through freewheel diode 322, instead of through switch 318. The PWM control regulates the coil current in order to provide sufficient force to hold the valve in position. When it is time for the coil to be deactivated, switch 318 remains open.

As discussed above, when switch 318 is closed, the voltage applied by one of energy storage devices 330 or 340 causes an energizing or charging current to be driven through the actuator, and through an energizing current pathway in which the switch is coupled. When the switch 318 is opened (either during the period in which valve is held open or closed, or during de-energizing of coil after the valve operation), the freewheel current resulting from the accumulated energy in the actuator is circulated through freewheel diode 322.

In addition, during de-energization, a bank turn-off or dissipation switch (350 or 360) may be opened to facilitate de-activation of any of the valve actuator subsystems 312. The switch may also be referred to as a fast-turn off switch since it may allow for faster turn-off as described herein. For the valve actuator subsystem 312 being deactivated, the freewheel current from the actuator is conducted through the freewheel current pathway defined through freewheel diode 322 and the respective freewheel diode 370 or 380, depending on which bank is being de-activated. Alternatively, if the dissipation switch (350 or 360) is left closed when switch 318 is opened, the freewheel current from the actuator is conducted through the freewheel current pathway defined through the dissipation switch and the freewheel diode 322. In either case, freewheel current is circulated via the freewheel current pathway to one of the voltage supply/energy storage devices 330 or 340.

Specifically, through use of dissipation switches 350 and 360, faster coil deactivation can be achieved since the switching operation varies a terminal voltage or voltage drop across the actuator(s) being de-energized. Accordingly, the dissipation switches are operable to rapidly quench the deactivation current and thereby selectively control the rate at which energy stored in an actuator coil is dissipated.

Referring still to FIG. 3, the valve actuation subsystems 312 may be configured in boost configurations or buck configurations. Referring first to valve actuation subsystems 312*a–d,* those subsystems are arranged in a boost (bank 1) configuration. Specifically, energization of any of the actuators 314*a–d* and resulting freewheel currents cause energy from energy storage device 330 to boost the voltage in energy storage device 340 (e.g., boost the voltage).

Referring particularly to valve actuation subsystem 312*a,* the actuator is energized by first closing switch 318*a.* The voltage applied from supply 332 cause an increasing current to be driven through actuator 314*a* and switch 318*a* , since the actuator and switch are coupled in series between supply 332 and a ground voltage. At a desired current level, the switch begins to open and close rapidly based on current-sense and PWM control signals applied to supply 320*a.* This causes the current to decrease and increase in the neighborhood of the desired current level, in order to substantially maintain a desired holding force or opening or closing force for the valve.

When the switch 318*a* is open and switch 350 is closed (e.g., regular deactivation), freewheel diode 322*a,* which is coupled with actuator 314*a* in series between supply 322 and capacitor 340, provides a freewheel current path. The freewheel current path allows freewheel current from actuator 314*a* to circulate to capacitor 340, in order to charge up or maintain a desired charge on the capacitor. Freewheel current is dumped to capacitor 340 through freewheel diode 322*a* while the valve is being held open or closed (i.e. while switch 318*a* is open during the period in which the switch is opening and closing rapidly), and during the de-energization of the actuator (e.g., as the valve is released from being held open or closed). For example, as valve 212 is released from the fully closed position of FIG. 2A, upper coil 216 would circulate a freewheel current during the period of de-energization. Where coil 216 is configured as a stage 1 boost driver in system 310, this freewheel current could be dumped to capacitor 340. Valve actuation subsystems 312*b–d* operates similarly in a boost mode, so as to dump freewheel current to capacitor 340.

When the switch 318*a* is open and switch 350 is opened (e.g., fast-turn off deactivation), freewheel diode 370, which is coupled in series between actuator 314*a* and ground, provides part of the freewheel current path, instead of the path running through the dissipation switch. The opening of dissipation switch 350 allows the full boosted voltage of capacitor 340 relative to ground to be used to quench the freewheel current circulating through the actuator. The fast turn-off freewheel current path allows freewheel current from actuator 314*a* to circulate to capacitor 340. For example, as valve 212 is released from the fully closed position of FIG. 2A, upper coil 216 would circulate a freewheel current during the period of de-energization.

Valve actuation subsystems 312*e–h* are buck (bank 2) configurations, relative to capacitor 340, in that capacitor 340 acts as a voltage source for energizing actuators 314*e–h*. Referring particularly to subsystem 312*e*, when switch 318*e* is first closed to energize actuator 314*e* and initiate the valve operation (e.g., opening or closing), current rises through actuator 314*e* because of the voltage drop between capacitor 340 and the supply voltage at capacitor 334. While the valve is being held open or closed, switch 318*e* opens and closes, so that current is alternately conducted through switch 318*e* and a freewheel current path containing freewheel diode 322*e*. The freewheel path allows freewheel current from actuator 314*e* to circulate back to energy storage device 330 (e.g., to charge up and/or maintain the charge on capacitor 334). As noted above, deactivation can be accomplished via fast turn-off switch 360 and diode 380, thereby allowing fast turn-off freewheel current to be re-circulated to capacitor 340, with a rapid quenching of freewheel current occurring as a result of the full boosted voltage across capacitor 340 relative to ground.

To summarize the boost-buck characteristics of system 310, actuators 314*a–d* are configured as boost drivers, which draw voltage from supply 330 and supply freewheel current to capacitor 340, thus charging up capacitor 340. Actuators 314*e–h* are configured as buck drivers, which draw supply voltage from capacitor 340 and return current (stored energy) from capacitor 340 back to capacitor 334. Stage 1 therefore stores energy in capacitor 340 during the operating cycles of actuators 314*a–d*, and returns that stored energy back to the power supply during the operating cycles of buck actuators 314*e–h*. However, in the case of fast-turn off via fast turn-off switches 350 or 360, fast turn-off freewheel current takes a different path through the respective fast turn-off freewheel diodes 370 or 380 to charge capacitor 340, regardless of whether source 330 or 340 is used to drive the actuator during energization.

Accordingly, it will be appreciated that in the case of multiple stages, in a given stage, the components that create the regulated voltage drop across the stage can act as a voltage source to drive actuators, or as a recipient of actuator charging currents and/or freewheel currents. Power supply 322 and capacitor 334 act as a voltage source to drive current through boost actuators 314*a–d*, and as a recipient of current from actuators 314*e–f*. Capacitor 340 is a recipient of current from the stage 1 boost actuators and stage 2 buck actuators, and a source for the stage 1 buck actuators and stage 2 boost actuators. A second stage may be added by providing additional actuator subsystems coupled in parallel between capacitor 340 and a third capacitor (not shown). This third capacitor would act as a current recipient for the stage 2 boost actuators and a source for the stage 2 buck actuators.

As stated above, the example approach of FIG. 3 describes a system that allows multiple coil driver circuits to operate from one fast turn-off circuit.

The following calculations illustrate an example advantage of such a system. The time period required for the current to decay may be approximated by dt=(L*di)/(V-IR). This time period is typically 1–2% of the coil L/R time constant, allowing fast turn-off operation to be performed without degradation of the required minimum coil holding current of the remaining coils which are on. During the time when the fast turn-off switch is off, the current freewheels through the diode to the other coil driver circuits which are on. The drivers for the remaining circuits which still need to be on are switched from PWM to full on (100% Duty Cycle) in order to allow the current to freewheel without dropping substantially. After the desired fast turn-off is accomplished, the main mosfet switch is turned back on and the remaining driver circuits which were fully on are returned to the normal holding PWM. The fast turn-off circuit can also be used to reduce pullin current down to the holding current.

As such, there may be several advantages of a fast turn-off circuit for each stage of EVA coil drivers, including single switch type drivers. Namely, there may be an energy savings when the coil current is reduced faster than can normally be achieved with a full bridge or half bridge circuit. This energy savings may be due to the reduced RMS coil current in each cycle thus reducing eddy current losses in the magnetic core and $I^2R$ losses in the coil. Also, the control of the actuator armature soft landing can be improved, thereby reducing the impact force of the engine valve on the valve seat and thus reducing the wear and audible valve noise. Also, in the case where only one fast turn-off circuit is used for each stage of coil driver circuits, the cost of the system may be lower when compared to coil drivers circuits which have independent fast turn-off circuits on the output of each coil driver. However, additional fast turn-off circuits can be used, if desired.

Another advantage of this circuit configuration, including the fast turn-off circuit (addition of Switch 350 and diode 370 for the boost), for example, is that it may allow large or larger number of actuator subsystems to be employed because in this system the actuator L/R time constant is long relative to the time required for turn-off of one actuator. This L/R time constant can be typically 10 to 100 times longer than the fast turn-off time, and therefore, the circuit can service (provide a fast turn-off) a large number of actuators without degrading or loosing current control of the remaining actuators that may be in PWM holding mode. For example, while four coils are grouped with a single fast turn-off circuit, it could be 8, 12, etc. This can be especially advantageous in multi-cylinder engines having a plurality of electrically actuated intake and/or exhaust valves. Of course, the number of coils per fast turn-off circuit could be as few as 2.

Note also that in one example two open intake coils may be in parallel (lower coils) or two close intake coils may be driven in parallel by one common power mosfet. As such, such an example configuration may be able to use enable power mosfet devices. Further, the enable power device can be used in at least two different EVA engine valve configurations and operating modes.

In a first configuration, a 4 Valve/Cylinder engine system is provided without alternating exhaust and without alternating intake valve function. This configuration assumes parallel control on pairs of upper exhaust, lower exhaust, upper intake and lower intake valves. In this type of engine application, the open enable power switch can feed two open coils, namely both lower intake (LI) valve coils. Another close enable power switch feeds the two close coils, both upper intake (UI) valve coils. The lower exhaust valve coils may be configured separate from the lower intake and upper intake because the lower exhaust valves may operate at the same time as the upper intake valves. In other words, the valve timing may prevent all open coils in a given cylinder from being fed by a single common enable switch. The same is true for timing restrictions that may occur between the lower intake and the upper exhaust (LI and UE). This configuration can use a total of 6 diodes and 6 mosfets (switches) per 8 valve coils, and removes one power switch, power diode and driver on the LE2 and UE2 exhaust valve coils.

In a second configuration, a 4 valve/cylinder engine with alternating exhaust (AE) and without alternating Intake (no AI) can be used. This system may be advantageous because of the large controller energy savings at low engine speed and light engine loads when alternating each exhaust valve on every other combustion cycle. This engine application (alternating exhaust AE) may require an extra diode and mosfet to control the two exhaust valves independently from one another. The alternating exhaust buck configuration and the boost configuration has a total of 7 diodes and 7 mosfets (switches) per 8 valve coils.

The open enable/close enable engine system in configuration 1 or 2 described above can also benefit from the fast turn-off of the coil driver because the enable circuit assumes a free wheel diode with each enable mosfet. The combination of the enable mosfet and the free wheel diode allows the coil current to circulate when the enable switch is shut off. This free wheeling current can circulate in the case where the coil current has not gone completely to zero when a transition from open to close coils is desired or simply when fast turn-off is desired for improved soft landing control. The boost and buck examples described above may be configured in many combinations of intake buck and exhaust boost or intake boost and exhaust buck to allow balanced loads for single stage and two stage single switch power stage designs.

Example circuit operation is now described. In general, the switch 350 for the boost branch is normally enabled or turned on to supply current to the boost branch or boost stage. Any combination of coils on, off, or PWM operating conditions can exist in the boost stage. At the instant when the boost stage coil driver 318*a* is turned off then switch 350 is opened and any of the remaining switches which were in the PWM mode are switched to full on to provide the lowest impedance to current flow during the time period when switch 350 is open. During this period when switch 350 is opened, the coil voltage reverses and drops to approximately 0.7 volts below Vin- and the diode 370 conducts to supply the current to the remaining coil driver circuits which are still commanded on. During this period the 314*a* actuator coil current is monitored by the controller to determine when the coil current has reduced to the desired level. The desired level could be to reduce the current from pull-in down to holding current or from a holding current level down to approximately zero. When the current in coil 314*a* has reached the desired level, then the fast turn off switch is re-enabled and the remaining circuits which were switched to full on are returned to PWM to maintain the proper holding current.

This process of quenching the coil current by using a source side switch allows one circuit to work for all of the boost branch or boost stage circuits which are common without having to increase the voltage further on capacitor 340. This fast turn-off switch circuit can also be used in a manner in which the voltage on storage capacitor 340 is reduced to a value between 1 and 2 times the source voltage 320*a,* for example. By reducing the voltage on capacitor 340, this circuit can still produce a higher di/dt than the full or half bridge circuit and not require substantially higher voltage ratings of the coil driver circuits and capacitor.

What is claimed is:

1. A system for electronically actuating valves in an internal combustion engine, comprising:

a first voltage source;

a second voltage source;

plural cylinder valve actuator subsystems coupled between the first voltage source and the second voltage source, each having a valve actuator and a switch configured to selectively control application of voltage to the valve actuator to thereby selectively control energization of the valve actuator;

a dissipation switch operatively coupled with the valve actuator subsystems, the dissipation switch being selectively operable to control dissipation of energy from any of the valve actuators;

wherein the second voltage source is connected in parallel with the plural valve actuator subsystems; and wherein freewheel current from each of the plural valve actuator subsystems is configured to be recycled though the second voltage source and made available to any of the plural valve actuator subsystems, the second voltage source not being a battery.

2. The system of claim 1, where the dissipation switch is configured to vary a rate at which energy is dissipated from the valve actuators.

3. The system of claim 1, where the dissipation switch is configured to vary a terminal voltage of the valve actuators to control dissipation of freewheel current from the valve actuators.

4. The system of claim 1, where the valve actuator subsystems are configured as boost subsystems, such that, for each valve actuator subsystem, current flows from the first voltage source to the valve actuator when the switch is in a first position, and current is permitted to flow from the valve actuator to the second voltage source when the switch is in a second position.

5. The system of claim 4, further comprising plural additional valve actuator subsystems coupled between the first voltage source and the second voltage source, each additional valve actuator subsystem having a valve actuator and a switch in a buck configuration, such that current flows from the second voltage source to the valve actuator when the switch is in a first position, and current is permitted to flow from the valve actuator to the first voltage source when the switch is in a second position.

6. The system of claim 5, further comprising a second dissipation switch operatively coupled with the additional valve actuator subsystems and configured to selectively control energy dissipation from the valve actuators of the additional valve actuator subsystems.

7. The system of claim 5, where for each the plural valve actuator subsystems, the valve actuator and the switch are coupled in series between the first voltage source and a ground voltage, and where for each of the plural additional valve actuator subsystems, the valve actuator and the switch are coupled in series between the second voltage source and the first voltage source.

8. The system of claim 1, where the second voltage source includes a capacitor, the capacitor being selected to charge to a voltage higher than a voltage of the first voltage source.

9. The system of claim 1, where for each valve actuator subsystem, the valve actuator subsystem further includes a freewheel diode configured to permit freewheel current to circulate from the valve actuator to one of the first voltage source and the second voltage source upon opening of the switch.

10. The system of claim 9, where for each valve actuator subsystem, the switch and the freewheel diode provide alternate pathways for current flowing through the valve actuator, the alternate pathways being selected based on whether the switch is opened or closed.

11. The system of claim 1, further comprising a second stage, in which plural additional valve actuator subsystems are coupled between the second voltage source and a third voltage source, each of the additional valve actuator subsystems having a valve actuator and a switch configured to selectively control application of voltage to the valve actuator to thereby selectively control energization of the valve actuator, the system further comprising an additional dissipation switch operatively connected with and associated with the additional valve actuator subsystems of the second stage and selectively operable to control dissipation of energy from any of the valve actuators of the second stage.

12. A system for electronically actuating valves in an internal combustion engine, comprising:

a first voltage source;

a second voltage source;

a first bank of valve actuator subsystems coupled between the first voltage source and the second voltage source, each having a valve actuator and a switch and configured so that, during operation, current flows from the first voltage source through the valve actuator when the switch is in a first position, and when the switch is in a second position, current is permitted to flow from the valve actuator to the second voltage source;

a second bank of valve actuator subsystems coupled between the first voltage source and the second voltage source, each having a valve actuator and a switch and configured so that, during operation, current flows from the second voltage source through the valve actuator when the switch is in a first position, and when the switch is in a second position, current is permitted to flow from the valve actuator to the first voltage source; and a dissipation switch selectively operable to vary dissipation of freewheel current from at least some of the valve actuators.

13. The system of claim 12, where the dissipation switch is associated with the first bank of valve actuator subsystems so as to control dissipation of freewheel current from valve actuators of the first bank of valve actuator subsystems, and where the system further comprises a second dissipation switch associated with the second bank of valve actuator subsystems and selectively operable to vary dissipation of freewheel current from valve actuators of the second bank of valve actuator subsystems.

14. The system of claim 12, where for said at least some of the valve actuators, the dissipation switch is configured to vary a terminal voltage of the valve actuators to control dissipation of freewheel current from the valve actuators.

15. The system of claim 12, where the second voltage source includes a capacitor, the capacitor being selected to charge to a voltage higher than a voltage of the first voltage source.

16. An internal combustion engine, comprising:

a plurality of cylinders, each having one or more valves that are selectively openable and closable; and a system for electronically actuating the valves, the system including:

a first voltage source;

a second voltage source;

plural cylinder valve actuator subsystems coupled between the first voltage source and the second voltage source, each having a valve actuator and a switch configured to selectively control application of voltage to the valve actuator to thereby selectively control energization of the valve actuator;

a dissipation switch operatively coupled with the valve actuator subsystems, the dissipation switch being selectively operable to control dissipation of energy from any of the valve actuators; and wherein freewheel current from each of the plural valve actuator subsystems is configured to be recycled though the second voltage source and made available to any of the plural valve actuator subsystems through a continuously connected current path.

17. The engine of claim 16, where the dissipation switch is configured to vary a rate at which energy is dissipated from the valve actuators.

18. The engine of claim 16, where the dissipation switch is configured to vary a terminal voltage of the valve actuators to control dissipation of freewheel current from the valve actuators.

19. The engine of claim 16, where the valve actuator subsystems are configured as boost subsystems, such that, for each valve actuator subsystem, current flows from the first voltage source to the valve actuator when the switch is in a first position, and current is permitted to flow from the valve actuator to the second voltage source when the switch is in a second position.

20. The engine of claim 19, further comprising plural additional valve actuator subsystems coupled between the first voltage source and the second voltage source, each additional valve actuator subsystem having a valve actuator and a switch in a buck configuration, such that current flows from the second voltage source to the valve actuator when the switch is in a first position, and current is permitted to flow from the valve actuator to the first voltage source when the switch is in a second position.

21. The engine of claim 20, further comprising a second dissipation switch operatively coupled with the additional valve actuator subsystems and configured to selectively control energy dissipation from the valve actuators of the additional valve actuator subsystems.

22. The engine of claim 16, where the second voltage source includes a capacitor, the capacitor being selected to charge to a voltage higher than a voltage of the first voltage source.

23. The engine of claim 16, where for each valve actuator subsystem, the valve actuator subsystem further includes a freewheel diode configured to permit freewheel current to circulate from the valve actuator to one of the first voltage source and the second voltage source upon opening of the switch.

24. The engine of claim 23, where for each valve actuator subsystem, the switch and the freewheel diode provide alternate pathways for current flowing through the valve actuator, the alternate pathways being selected based on whether the switch is opened or closed.

* * * * *